US006098676A

United States Patent [19]

Poynter et al.

[11] Patent Number: 6,098,676

[45] Date of Patent: Aug. 8, 2000

[54] ASEPTIC LIQUID FILLINGS

[75] Inventors: Richard Q. Poynter; Jeffrey L. Price, both of Palm Beach Gardens; Michael J. Schoenewolff, West Palm Beach, all of Fla.

[73] Assignee: Vital Signs Inc., Totowa, N.J.

[21] Appl. No.: 09/255,308

[22] Filed: Feb. 22, 1999

Related U.S. Application Data

[63] Continuation-in-part of application No. 09/021,473, Feb. 10, 1998.

[51] Int. Cl.[7] ..... B65B 1/04

[52] U.S. Cl. ..... 141/93; 141/85; 222/630; 454/188

[58] Field of Search ..... 141/85, 89, 90, 141/91, 92, 93; 222/603, 630; 239/545; 454/187, 188

[56] References Cited

U.S. PATENT DOCUMENTS

| | | | |
|---|---|---|---|
| 3,629,999 | 12/1971 | Marsh et al. | 55/97 |
| 4,037,830 | 7/1997 | Poluzzi et al. | 269/21 |
| 4,427,424 | 1/1984 | Charpin et al. | 55/158 |
| 5,267,591 | 12/1993 | Wskabayashi et al. | 141/91 |
| 5,366,409 | 11/1994 | Riley | 454/188 |
| 5,860,461 | 1/1999 | Helmut | 141/92 |

*Primary Examiner*—Steven O. Douglas
*Assistant Examiner*—Khoa Huynh
*Attorney, Agent, or Firm*—R. Gale Rhodes, Jr.

[57] ABSTRACT

Process and apparatus for providing a HEPA air shower to the critical fill zone of the liquid filling operation for preventing entry of particulate, non-viable and viable particulate, into the critical filling zone by providing opposed flows of pressurized HEPA air, by providing opposed laminar flows of pressurized HEPA air, or by providing a single laminar flow of pressurized HEPA air to the critical filling zone to provide the HEPA air shower.

24 Claims, 4 Drawing Sheets

FIG. 2
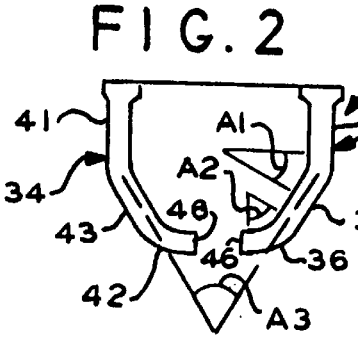
FIG. 3
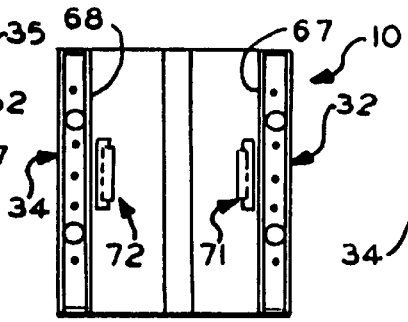
FIG. 4
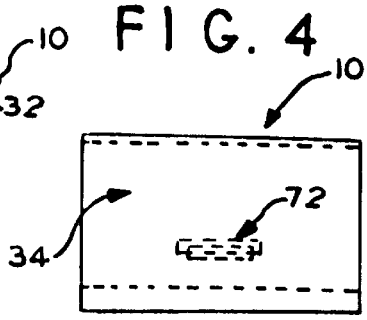
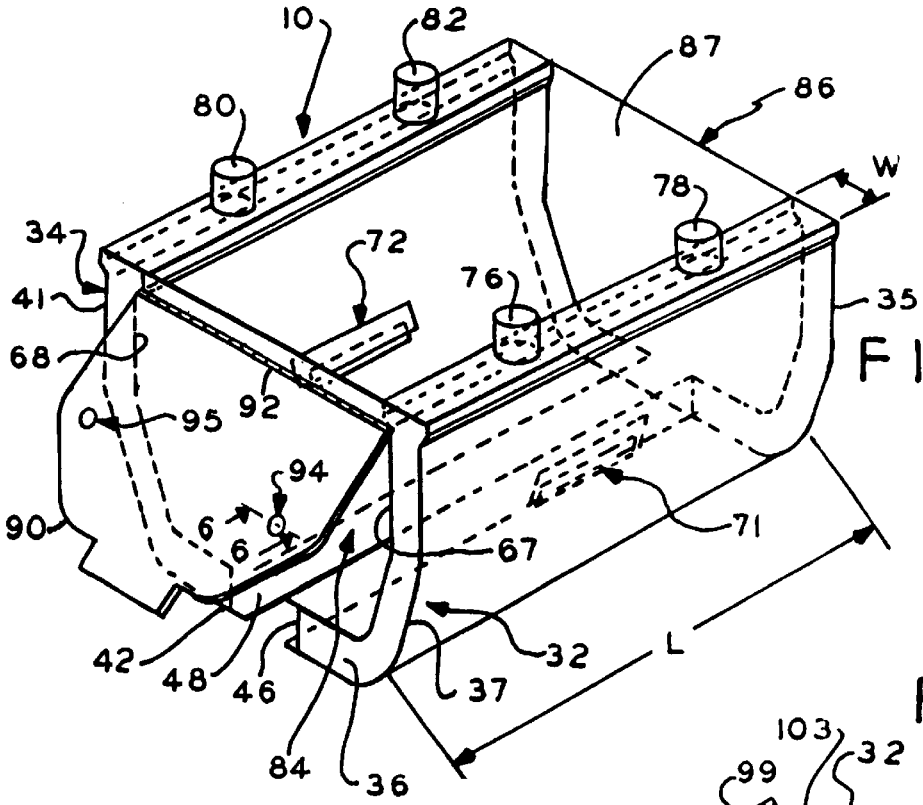
FIG. 5
FIG. 6
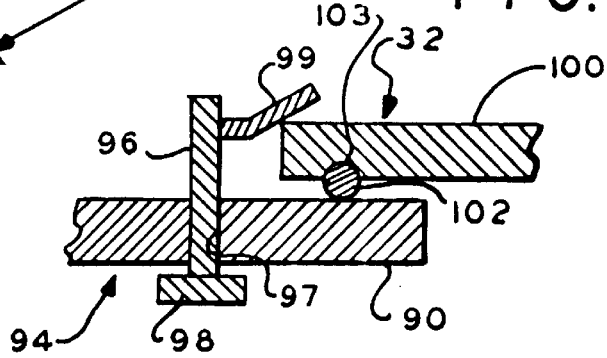

ASEPTIC LIQUID FILLINGS

CROSS REFERENCE TO RELATED APPLICATIONS

This application is a continuation-in-part of pending U.S. patent application Ser. No. 09/021,473, filed Feb. 10, 1998, entitled ASEPTIC LIQUID FILLING, Richard Q. Poynter, et al. inventors, and which application is assigned to the same assignee as this application.

BACKGROUND OF THE INVENTION

This invention relates generally to aseptic liquid filling and more particularly relates to process and apparatus for providing a HEPA air shower to the critical fill or filling zone of a liquid filling operation, such as for example a blow-fill-sealing operation, to prevent entry of particulate, non-viable and viable particulate, into the critical filling zone. Further, particularly, this invention relates to process and apparatus for providing such HEPA air shower in the form of a single or opposed dual laminar, or at least substantially laminar, flow or flows of pressurized HEPA air.

Numerous patents disclose methods and apparatus for forming, such as by blow molding, filling such as with a liquid, and sealing a container containing the liquid. Note for example, U.S. Pat. Nos. 3,251,915; 3,464,085; 3,523,401; 3,597,793; 3,664,793; 3,674,405; 3,719,374; 4,176,153; 4,178,976; 4,997,014 and U.S. Pat. No. Re. 27,155; and patents cited therein.

As generally known to those skilled in the art, the blow-fill-sealing process is an automated process by which plastic containers are formed, filled with liquid, and sealed in one continuous operation. More particularly, and as further known to those skilled in the art, in the blow-fill-sealing process a hollow, cylindrical plastic parison is extruded downwardly between cavities provided in pairs of open and opposed main and sealing molds mounted for reciprocal movement toward and away from each other; the mold cavities are shaped complementarily to the plastic container to be formed. The main molds are then closed around the plastic parison to seal the bottom of the container after which pressurized air, in the blow molding step, is forced into the plastic parison to force the plastic parison outwardly against the walls of the main mold cavities to partially form the container but leaving the container top open for subsequent liquid filling. Thereafter, a liquid fill nozzle is advanced above, or slightly into, the open top of the partially formed plastic container and liquid, such as a sterile liquid, e.g., a pharmaceutical solution, is injected or dispensed into the partially formed plastic container after which the nozzle is withdrawn and the seal molds are closed to seal the upper portion of the container and complete a pre-liquid filled plastic container.

Aside from the economic advantages of the blow-fill-sealing process, such process is a favored process for aseptic filling of sterile liquid products, such as the above-noted pharmaceutical solution, due to the limited need for human intervention in the process, and hence minimal opportunity for microbial or pathogenic microorganism contamination due to human intervention. One limitation, as is also known to those skilled in the art, is that in the blow-fill-sealing process non-viable particulate, or particulate matter or particles, are generated during the extrusion of the plastic parison in the container blow-fill-sealing process noted above. These non-viable particulate can potentially provide the means of transport for viable microorganisms, particularly pathogenic microorganisms, into the partially formed and open plastic container prior to the sealing step. As is still further known to those skilled in the art, in an effort to protect the pre-liquid fill product produced by the blow-fill-sealing process, blow-fill-sealing apparatus or machine have been provided with shrouds at the critical fill or filling zone. The critical filling zone, as known to the art and as used hereinafter and in the appended claims, means the zone immediately surrounding or encompassing the open top of the partially formed plastic container and at least a portion of the liquid fill nozzle, such critical filling zone is shown by the dashed circle in FIG. 1 bearing numerical designation 30; such critical filling zone is sometimes referred to in the art as the fill/nozzle area.

A prior art shroud known to the art for preventing entry of the particulate into the critical filling zone includes a single duct for receiving and communicating a single flow of pressurized high efficiency particulate air (HEPA air) from a single direction to the critical filling zone to prevent entry of particulate to the critical filling zone; such flow of pressurized HEPA air to the critical filling zone is referred to in the art and hereinafter and in the appended claims as a HEPA air shower. It has been found that such flow of pressurized HEPA air provided by prior art process and apparatus is a non-laminar, or at least substantially non-laminar, flow of pressurized HEPA air and it has been found that such flow of pressurized HEPA air can produce vortex, or vortices, in the critical filling zone which vortex, or vortices, can undesirably draw particulate into the critical filling zone.

However, there exists a need in the art for improved process and apparatus for more effectively preventing entry of particulate, non-viable and viable particulate, into the critical filling zone to further enhance aseptic liquid filling of products, such as for example, pre-liquid filled plastic containers produced by the above-noted blow-fill-sealing operation.

SUMMARY OF THE INVENTION

It is the object of the present invention to satisfy the foregoing need in the art.

Process and apparatus satisfying such need and embodying the present invention include process and apparatus for providing a HEPA air shower to the critical filling zone of the liquid filling operation for preventing entry of particulate, non-viable and viable particulate, into the critical filling zone of a liquid filling operation by providing opposed flows of pressurized HEPA air, by providing opposed laminar flows of pressurized HEPA air, or by providing a single laminar flow of pressurized HEPA air into the critical filling zone to provide the HEPA air shower.

DESCRIPTION OF THE DRAWINGS

FIG. 2 is an outline front elevational view of the shroud of FIG. 1;

FIG. 3 is a top view of the shroud shown in FIG. 2;

FIG. 4 is a left side view of the shroud shown in FIG. 2;

FIG. 5 is a perspective view of the shroud shown in FIGS. 1–4;

FIG. 6 is a cross-sectional view of a fastener of the present invention for fastening the pivotally mounted door to the shroud; the view is taken generally downwardly along the line 6—6 in FIG. 1 but shown in FIG. 6 with the door fastened to the shroud;

DESCRIPTION OF THE PREFERRED EMBODIMENT

Figure 1:
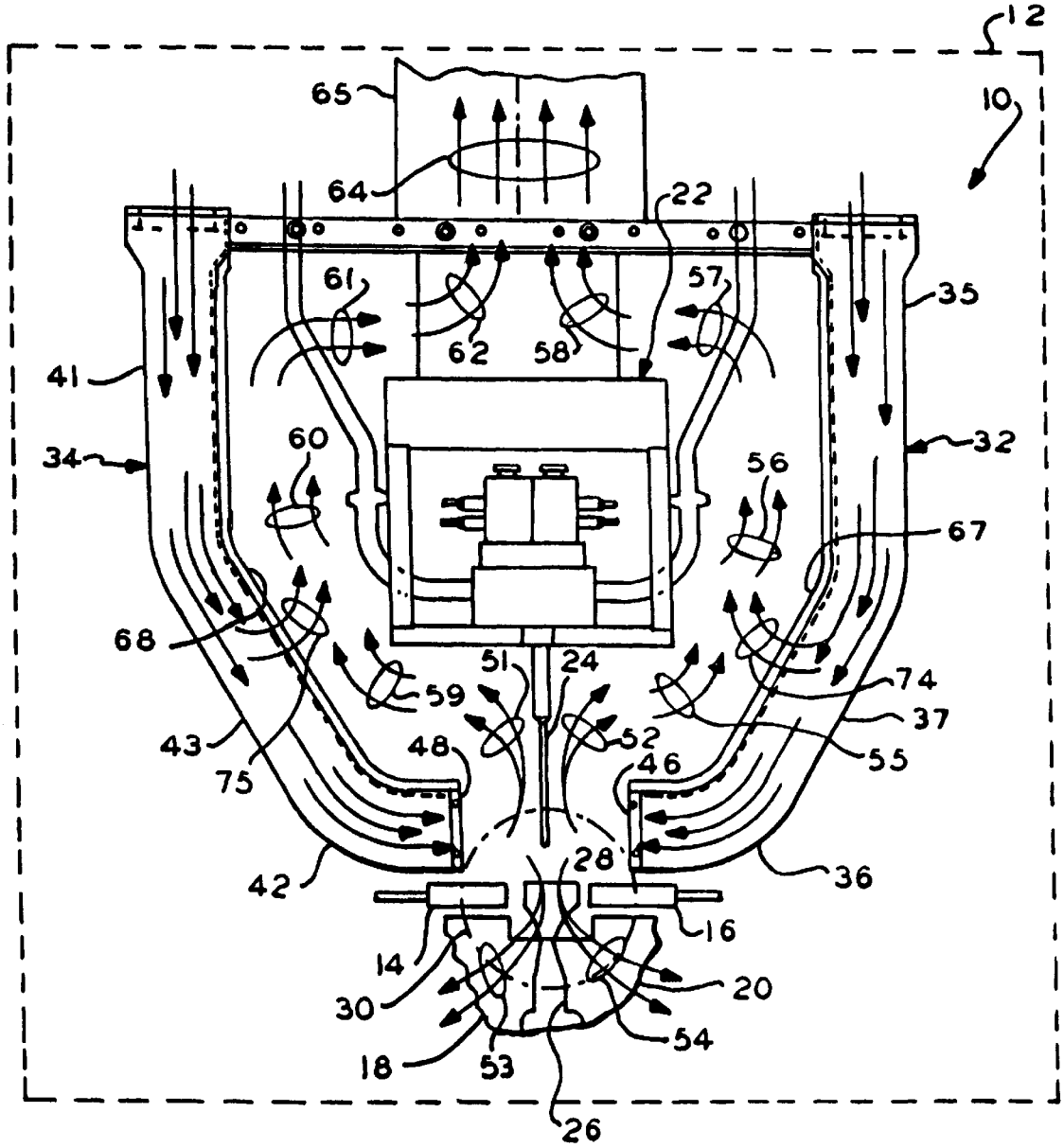
FIG. 1 is a front end elevational view of a shroud embodying the present apparatus invention and particularly useful for practicing the process of the present invention, the blow-fill-seal apparatus or machine on which the shroud of the present invention is mounted is indicated by the surrounding dashed rectangular outline and which machine includes seal molds and main molds partially shown in solid outline.

Referring to the drawings, and in particular to FIG. 1, a generally U-shaped shroud embodying the present invention is shown and indicated by general numerical designation 10. In FIG. 1, the shroud 10 is mounted suitably to blow-fill-seal apparatus or machine indicated diagrammatically by the dashed rectangular outline 12 surrounding the shroud 10 and which blow-fill-seal machine may be any suitable blow-fill-seal machine known to the art such as, for example, a blow-fill-seal machine available from Automatic Liquid Packaging, Inc. of Woodstock, Ill. and from Vital Pharma, Inc. of Riviera Beach, Fla. As known to the art, the blow-fill-seal machine 12 includes a pair of partially shown opposed and reciprocally mounted seal molds 14 and 16 and a pair of partially shown opposed and reciprocally mounted main molds 18 and 20. The blow-fill-seal machine or apparatus 12 further includes, as known to the art, liquid filling apparatus or system indicated by general numerical designation 22 which includes a liquid filling nozzle 24. A partially formed plastic container, partially formed by the above-noted blow-molding step, is shown in FIG. 1 and indicated by numerical designation 26. The partially formed plastic container 26 includes an open upper portion or top having an opening indicated by numerical designation 28. The critical fill or filling zone as noted above is indicated by the dashed circle 30 in FIG. 1. It will be further understood from FIG. 1 that the shroud 10 is mounted suitably to the blow-fill-seal machine 12 to at least partially enclose or surround the liquid filling system 22.

Referring further to the drawings, and in particular to FIGS. 1, 2 and 5, the shroud 10 includes a pair of opposed, hollow ducts indicated by general numerical designations 32 and 34. Duct 32, particularly FIG. 2, includes a linearly extending vertical upper portion 35, a linearly extending horizontal lower portion 36, and a linearly extending angular intermediate portion 37 intermediate and interconnecting the upper and lower duct portions 35 and 36. Duct 34 includes a linearly extending vertical upper portion 41, a linearly extending horizontal lower portion 42, and a linearly extending angular intermediate portion 43 intermediate and interconnecting the upper and lower portions 41 and 42. It will be particularly understood with regard to representative duct 32, and FIG. 2, that the intermediate angular portion 37 of duct 35 is disposed angularly with respect to both the upper portion 35 and the lower portion 36 and forms a first included angle A1 with respect to the upper vertical portion 35 and a second included angle A2 with respect to the lower horizontal portion 36; the angular portion 43 of duct 34 is similarly angularly disposed with respect to duct portions 41 and 42. In the preferred embodiment, the first included angle A1 is about 150° and the second included angle A2 is about 120°. As will be further noted from FIG. 2, the angularly disposed intermediate portions 37 and 43 of the respective ducts 32 and 34 are disposed angularly with respect to each other at a third included angle A3 which in the preferred embodiment is about 60°.

As will be understood particularly from FIGS. 2 and 5, the lower portions 36 and 42 of the respective ducts 32 and 34 have opposed and spaced apart openings 46 and 48. As will be understood from FIG. 1, the ducts 32 and 34 are for receiving and communicating opposed flows of pressurized HEPA air, indicated by the arrows inside the ducts, through the opposed and spaced apart openings 46 and 48 to the critical filling zone 30 to provide a HEPA air shower indicated by the groups of arrows 51, 52, 53 and 54. The HEPA air shower provides a positive pressure region in the critical filling zone 30 which is positive with respect to the pressure of the air surrounding the critical filing zone 30 and which positive pressure region prevents the entry of non-viable and viable particulate into the critical filling zone. The groups of arrows 55, 56, 57 and 58 and groups of arrows 59, 60, 61 and 62, and arrows 64, indicate the exiting of the HEPA air and removal of particulate upwardly from the shroud 10 and through a suitable chimney 65 mounted above the shroud and to the blow-fill-seal machine 12. The HEPA air introduced into the ducts 32 and 34 is provided by a suitable HEPA air blower of the type known to the art and which HEPA air typically passes through a laminar flow grade 99.99% efficient filter. The velocity of such HEPA air typically is between 300–600 fpm.

As will be particularly noted from FIGS. 1, 3 and 5, the ducts 32 an 34 include, respectively, generally opposed inner walls 67 and 68 provided, respectively, with adjustable vents indicated by general numerical designations 71 and 72 for communicating variable portions of the pressurized HEPA air in the ducts to the interior of the shroud 10, as indicated by the pairs of arrows 74 and 75 shown in FIG. 1 to assist in carrying away the particulate. The adjustable vents 71 and 72 may be of the type known to the art including a slidable member mounted for reciprocal sliding movement to partially open, partially close, or fully shut or fully open, an associated opening or aperture.

As will be understood from FIG. 5 and representative duct 32, the ducts have a length L and a width W with the length L being greater than the width W. As will be further noted from FIG. 5, the upper portions of the respective ducts 32 and 34 are flared outwardly and the tops of the ducts are closed except for the openings 76 and 78 formed in the top of duct 35 and the openings 80 and 82 formed in the top of the duct 34; the openings are for admitting the pressurized HEPA air into the ducts.

As will be understood particularly from the perspective view of FIG. 5, the shroud 10 has an open forward end indicated by general numerical designation 84 and a closed rearward end indicated by general numerical designation 86 with the rearward end 86 being closed by a generally planar closure member 87 mounted suitably to the rearward portions of the ducts 32 and 34. The shroud 10 further includes a door 90 mounted pivotally or hingedly to the top portion of the shroud forward end 84 by a suitable hinge 92. The door 90 is complementary in shape to the shroud forward end 84 and in the preferred embodiment is made of a suitable transparent plastic to permit viewing, for example, of the liquid filling apparatus 22 shown in FIG. 1. The door 90 may be provided with a pair of fasteners indicated by general numerical designations 94 and 95 in FIG. 5.

As will be understood by reference to FIG. 6 and representative fastener 94, the fastener 94 includes a shaft 96 mounted rotatably in an opening 97 formed in the door 90, a manually rotatable knob 98 mounted fixedly to the shaft 96 for rotation therewith and an angular camming member 99 mounted fixedly to the shaft 96 for rotation therewith. The duct 32 may include a flange portion 100 as shown in FIG. 6. A gasket 102 may be provided in a groove 103 formed in the flange portion 100. Upon closure of the door 90, and upon manual rotation of the knob 98, the shaft 96 rotates the angular camming member 99 which forces the door toward the duct flange portion 100 compressing the gasket 102 placing the door in air tight engagement with the shroud 10.

Referring again to FIGS. 1, 2 and 5, it will be understood that the upper vertical portions 35 and 41 of the respective ducts 32 and 34 are substantially parallel and that the lower horizontal portions 36 and 42 of the respective ducts 32 and 34 reside substantially in the same horizontal plane.

Figure 7:
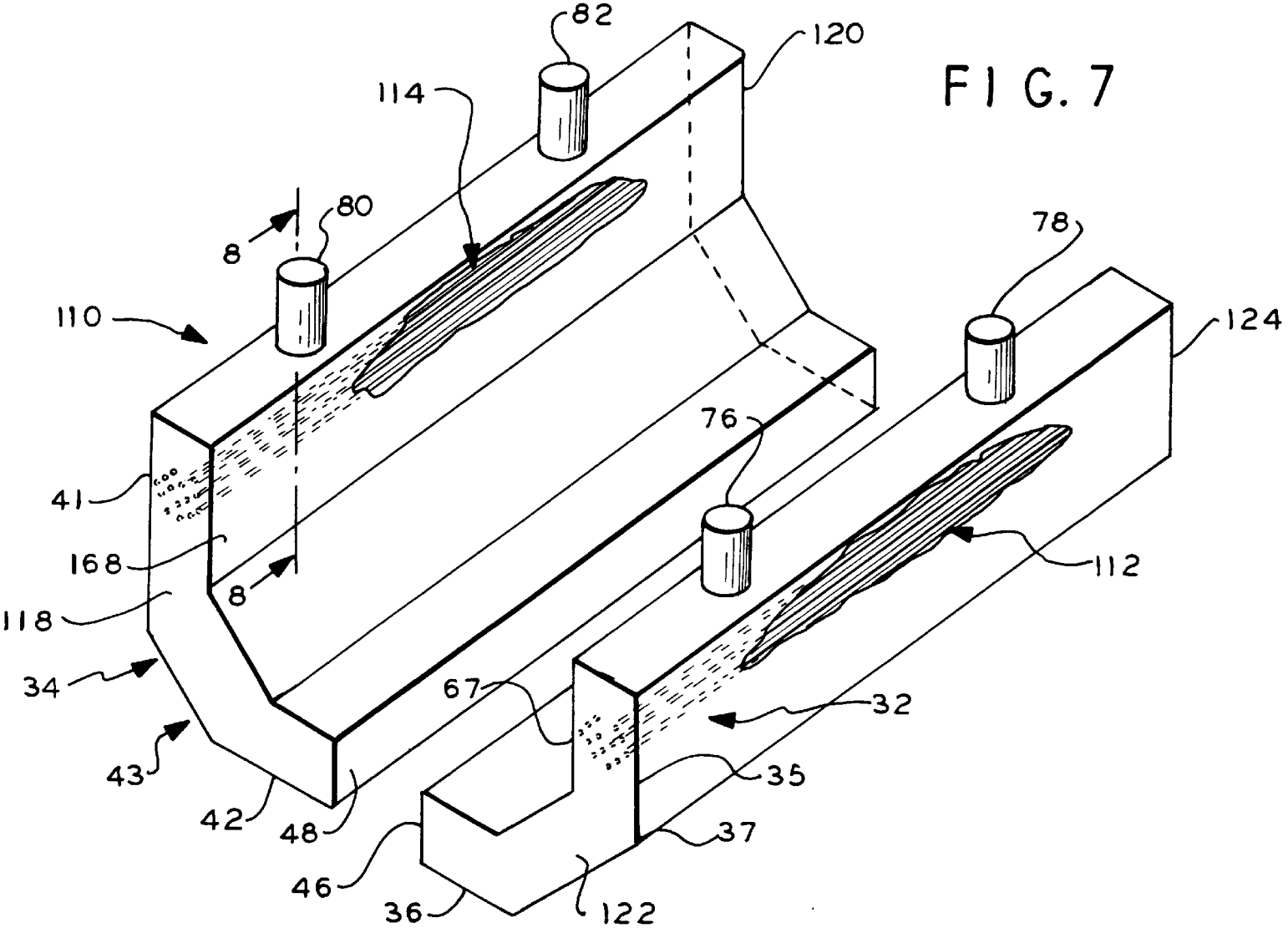
FIG. 7 is a view similar to FIG. 5 but showing an alternate embodiment of the present invention wherein a diffuser is mounted internally of the ducts comprising the shroud to provide opposed laminar flows of pressurized HEPA air.
Figure 8:
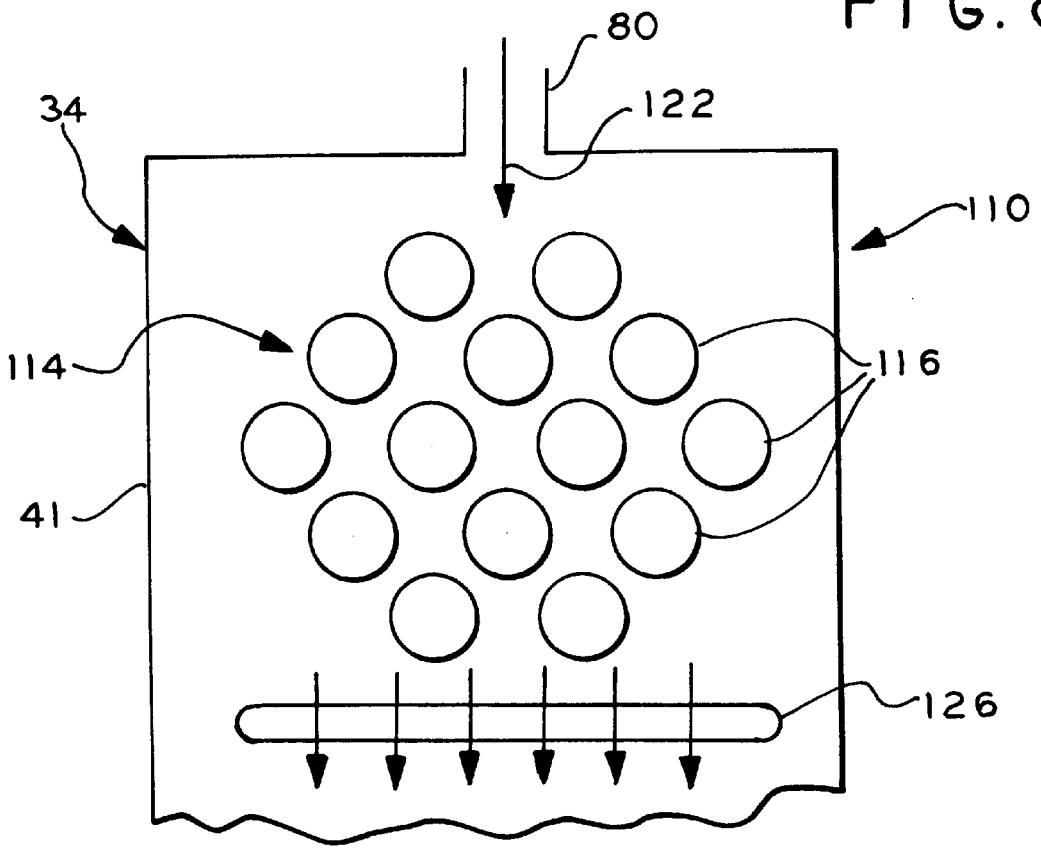
FIG. 8 is a diagrammatical, partial vertical view taken generally along the line 8—8 in FIG. 7 in the direction of the arrows.

An alternate embodiment of a generally U-shaped shroud embodying the present invention is shown in FIGS. 7 and 8 and indicated by general numerical designation 110. Elements of shroud 110 which are the same as the elements of shroud 10 are given the same numerical designations and perform the same functions as described hereinabove. In the shroud 110, ducts 32 and 34 are provided, respectively, with internally mounted diffusers indicated by general numerical designations 112 and 114. More particularly, the respective linearly extending vertical member portions 35 and 41 of such ducts are provided with such internally mounted diffusers 112 and 114.

As will be understood generally from FIG. 7 and particularly from FIG. 8 and with regard to representative linearly extending vertical portion 41 of duct 34, the diffuser 114 may be comprised of a plurality of horizontally disposed parallel and spaced apart cylindrical members, such as cylindrical rods or tubes 116 shown in FIG. 8 whose opposite ends are suitably mounted to the respective opposed front and rear walls 118 and 120 of duct 34, particularly to the portions of the front and rear walls comprising the vertical upper portion 41 comprising the duct 34, note FIG. 7. As will be further understood from FIG. 8, cylindrical members 116 are disposed or arrayed such that there is no vertical linear path extending therethrough. As will be further understood from FIG. 8, the cylindrical members 116 are disposed or arrayed in a plurality of horizontal rows of cylindrical members with the cylindrical members in each row of each horizontally adjacent pair of rows being staggered horizontally with respect to the cylindrical members in the other row of such adjacent pair of rows. It will be understood that the cylindrical members 116 comprising the diffuser 112 mounted internally of duct 32 are disposed or arrayed and mounted to the front and rear walls 122 and 124 of duct 32, particularly to the portion of the front and rear walls comprising the vertical upper portion 35 comprising the duct 32, in the same manner.

As stated above, a flow of pressurized HEPA air is introduced into the representative duct 34, FIG. 8, and such HEPA air is provided by a suitable HEPA air blower of the type known to the art and which HEPA air typically passes through a laminar flow grade 99.99% efficient filter at a velocity of typically between 300–600 fpm. However, it has been found that although such flow of pressurized HEPA air passes through a laminar flow grade efficient filter, the flow of pressurized HEPA air passing through such filter is non-laminar, or at least substantially non-laminar, and such non-laminar flow of pressurized HEPA air is indicated diagrammatically in FIG. 8 by arrow 122. In accordance with the teachings of the present invention, upon non-laminar, or at least substantially non-laminar, flow of pressurized HEPA air 122 contacting the cylindrical members 116 comprising the diffuser 114, and which cylindrical members are disposed perpendicular to the non-laminar flow of pressurized HEPA air, such non-laminar, or at least substantially non-linear, flow of pressurized HEPA air is diffused upon passing around and through the cylindrical members 116 and is converted into a linear, or at least substantially linear, flow of pressurized HEPA air as indicated diagrammatically by the plurality of arrows 126 in FIG. 8. Such laminar, or at least substantially laminar, flow of pressurized HEPA air 126 passes downwardly through the duct 34, FIG. 7, and exits the duct opening 48 and is admitted to the critical filling zone 30 of FIG. 1. Simultaneously, an opposed laminar, or at least substantially laminar, flow of pressurized HEPA air, from the diffuser 112 mounted internally of duct 32, exits the opening 46 of duct 32 whereby opposed laminar flows, or at least substantially laminar, flows of pressurized HEPA air is communicated to the critical filling zone 30, FIG. 1, through the ducts 32 and 34, FIG. 7, to provide a HEPA air shower which, as noted above, provides a positive pressure region in the critical filling zone 30, FIG. 1, which is positive with respect to the pressure of the air surrounding the critical filling zone 30 and which positive pressure region prevents, or at least substantially prevents, the entry of non-viable and viable particulate into the critical filling zone 30.

The ducts 32 and 34 may be made of suitable metal, such as stainless steel, and may be made and assembled using suitable metal manufacturing techniques known to the art. The cylindrical members 116 comprising the diffusers 112 and 114 may be hollow cylindrical tubes made of a suitable metal such as stainless steel, and their opposed ends may be suitably mounted to the opposed front and rear walls of the ducts 32 and 34, FIG. 7, such as for example by welding.

Figure 9:
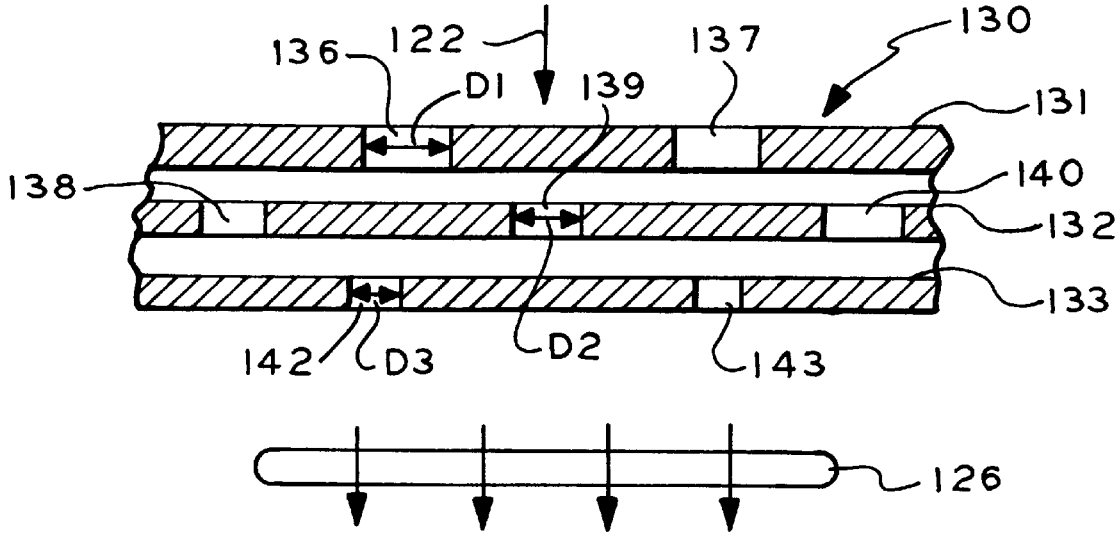
FIG. 9 is a diagrammatical, partial vertical view of an alternate embodiment diffuser for providing a laminar flow of pressurized HEPA air.

It will be further understood in accordance with the teachings of the present invention that it is contemplated that a single duct, such as for example duct 32 of FIGS. 7 and 8, be utilized to provide a single flow of laminar, or at least substantially laminar, pressurized HEPA air to the critical filling zone 30. Still further, it will be understood that alternative to the plurality of cylindrical members 116, FIG. 8, other diffusers may be utilized to provide a single, or opposed dual flows, of laminar, or at least substantially laminar, pressurized HEPA air to the filling zone, and such alternate diffusers may include the alternate embodiment diffuser for providing a laminar flow of pressurized HEPA air shown in FIG. 9 and indicated by general numerical designation 130.

The diffuser 130 includes a plurality of vertically spaced apart and vertically aligned linear members or plates 131, 132 and 133. Each linear member is provided with a plurality of holes extending vertically therethrough, namely, linear member 131 is provided with a plurality of representative vertical holes 136 and 137, linear member 132 is provided with a plurality of representative holes 138, 139 and 140, and linear member 133 is provided with a plurality of representative holes 142 and 143. It will be noted that the holes provided in each linear member are displaced horizontally with respect to the holes provided in the next adjacent linear member such that there is no linear vertical path extending through the holes provided in the linear members and therefore through the diffuser 130. It will be further understood from FIG. 9 that the holes provided in the linear member 131 have a diameter D1, that the holes provided in the linear member 132 have a diameter D2, and that the holes provided in the linear member 133 have a diameter D3. It will be further understood that the diameter D1 is larger than the diameter D2, and that the diameter D2 is larger than the diameter D3 whereby the holes provided in the linear members 131, 132 and 133 decrease in diameter successively downwardly. Accordingly, similar to the diffuser 110 illustrated diagrammatically in FIG. 8, upon an at least substantially non-laminar flow of pressurized HEPA air 122 being passed downwardly through the diffuser 130, due to the lack of a vertical linear path through the holes of the diffuser 130, the pressurized HEPA air 122 will take a non-linear or tortuous path downwardly through the diffuser 130 and will produce upon exiting the diffuser 130 a linear, or at least substantially linear, flow of pressurized HEPA air indicated diagrammatically by the plurality of arrows 126.

It will be understood that many variations and modifications may be made in the present invention without departing from the spirit and the scope thereof.

What is claimed is:

1. Apparatus for providing a HEPA air shower to a critical filling zone of a liquid filling operation to prevent particulate from entering the critical filling zone, comprising:

a pair of generally U-shaped ducts having lower portions providing a pair of opposed and spaced apart openings through which opposed flows of pressurized HEPA air flow to the critical filling zone to provide the HEPA air Shower.

2. The apparatus according to claim 1 wherein each duct of said pair of ducts is provided with an internally mounted diffuser for receiving a non-laminar flow of pressurized HEPA air and is for converting said non-laminar flow of pressurized HEPA air into a laminar flow of pressurized HEPA air.

3. The apparatus according to claim 1 wherein said pair of ducts are for receiving and communicating opposed laminar flows of pressurized HEPA air through said opposed and spaced apart openings to the critical filling zone to provide a positive pressure region to the critical filling zone.

4. The apparatus according to claim 3 wherein said ducts include a linearly extending vertical upper portion and wherein linearly extending vertical upper portion of each duct is provided with an internally mounted diffuser for receiving a non-laminar flow of pressurized HEPA air and is for converting the non-laminar flow of pressurized HEPA air into a laminar flow of pressurized HEPA air.

5. The apparatus according to claim 4 wherein said diffuser comprises a plurality of spaced apart and parallel cylindrical members disposed perpendicular to the non-laminar flow of pressurized HEPA air.

6. The apparatus according to claim 5 wherein said duct includes a front wall and a rear wall and wherein said plurality of cylindrical members are mounted to and between said front wall and said rear wall.

7. The apparatus according to claim 5 wherein said plurality of cylindrical members are disposed such that there is no vertical linear path therethrough.

8. Apparatus according to claim 5 wherein said plurality of cylindrical members are disposed in a plurality of horizontal rows of cylindrical members with the cylindrical members in each row of each horizontally adjacent pair of rows being staggered horizontally with respect to the cylindrical members in the other row of said adjacent pair of rows.

9. Apparatus for providing a HEPA air shower to a critical filling zone of a liquid filling operation to provide a positive pressure region in the critical filling zone which is positive with respect to the pressure of the air surrounding the critical filing zone to prevent entry of particulate into the critical filling zone, comprising:

a shroud including a pair of generally opposed ducts, each duct including a linearly extending vertical upper portion, a linearly extending horizontal lower portion, and a linearly extending intermediate portion intermediate said upper portion and said lower portion, said intermediate portion disposed angularly with respect to said upper portion and said lower portion and forming a first included angle with respect to said upper portion and a second included angle with respect to said lower portion, said lower portions having opposed and spaced apart openings, and each of said ducts provided with an internally mounted diffuser for receiving a substantially flow of non-laminar pressurized HEPA air and for converting the flow of substantially non-laminar pressurized HEPA air into a flow of substantially laminar pressurized HEPA air to cause said ducts to communicate opposed flows of substantially laminar pressurized HEPA air through said opposed and spaced apart openings to the critical filling zone to provide the positive pressure region in the critical filling zone.

10. The apparatus according to claim 9 wherein said diffuser comprises a plurality of spaced apart and parallel cylindrical members disposed perpendicular to the flow of substantially non-laminar pressurized HEPA air.

11. The apparatus according to claim 10 wherein each of said ducts includes a front wall and a rear wall and wherein said plurality of cylindrical members are mounted to and extend between said front wall and said rear wall of each duct.

12. The apparatus according to claim 10 wherein said plurality of cylindrical members are disposed such that there is no vertical linear path therethrough.

13. Apparatus according to claim 10 wherein said plurality of cylindrical members are disposed in a plurality of horizontal rows of cylindrical members with the cylindrical members in each row of each horizontally adjacent pair of rows being staggered horizontally with respect to the cylindrical members in the other row of said adjacent pair of rows.

14. The apparatus according to claim 9 wherein said diffuser comprises a plurality of vertically spaced apart and vertically aligned linear members, each of said linear members provided with a plurality of holes extending vertically therethrough, and the holes in each vertical member being displaced horizontally with respect to the holes in the next adjacent vertical member such that there is no vertical linear path through said plurality of linear members.

15. The apparatus according to claim 14 wherein each of said ducts includes a front wall and a rear wall and wherein said plurality of linear members are mounted to and extend between said front wall and said rear wall of each duct.

16. The apparatus according to claim 14 wherein said holes in said laminar members decrease in diameter successively downwardly.

17. Apparatus for providing a HEPA air shower to a critical filling zone of a liquid filling operation to provide a positive pressure region in the critical filling zone which is positive with respect to the pressure of the air surrounding the critical filing zone to prevent entry of particulate into the critical filling zone, comprising:

a shroud including at least one duct, said duct including a linearly extending vertical upper portion, a linearly extending horizontal lower portion, and a linearly extending intermediate portion intermediate said upper portion and said lower portion, said intermediate portion disposed angularly with respect to said upper portion and said lower portion and forming a first included angle with respect to said upper portion and a second included angle with respect to said lower portion, said upper portion provided with an internally mounted diffuser for receiving a flow of substantially non-laminar pressurized HEPA air and for converting the flow of substantially non-laminar pressurized HEPA air into a flow of substantially laminar pressurized HEPA air and said lower portion provided with an opening for communicating the flow of substantially laminar pressurized HEPA air to the critical filling zone to provide the positive pressure region in the critical filling zone.

18. The apparatus according to claim 17 wherein said diffuser comprises a plurality of spaced apart and parallel cylindrical members disposed perpendicular to the flow of substantially non-laminar pressurized HEPA air.

19. Apparatus according to claim 18 wherein said plurality of cylindrical members are disposed in a plurality of horizontal rows of cylindrical members with the cylindrical members in each row of horizontally adjacent pair of rows being staggered horizontally with respect to the cylindrical members in the other row of said adjacent pair of rows.

20. The apparatus according to claim 18 wherein said diffuser comprises a plurality of vertically spaced apart and vertically aligned linear members, each of said linear members provided with a plurality of holes extending vertically therethrough, and the holes in each vertical member being displaced horizontally with respect to the holes in the next adjacent vertical member such that there is no vertical linear path through said plurality of linear members.

21. The apparatus according to claim 20 wherein said duct includes a front wall and a rear wall and wherein said plurality of linear members are mounted to and extend between said front wall and said rear wall.

22. The apparatus according to claim 21 wherein said holes in said laminar members decrease in diameter successively downwardly.

23. The apparatus according to claim 17 wherein said duct includes a front wall and a rear wall and wherein said plurality of cylindrical members are mounted to and extend between said front wall and said rear wall.

24. The apparatus according to claim 23 wherein said plurality of cylindrical members are disposed such that there is no vertical linear path therethrough.

* * * * *